US008894346B2

(12) United States Patent
Lewis

(10) Patent No.: US 8,894,346 B2
(45) Date of Patent: Nov. 25, 2014

(54) SKID STEER LOADER BLADE CONTROL

(75) Inventor: Brady Lewis, Peck, KS (US)

(73) Assignee: CNH Industrial America LLC, New Holland, PA (US)

( * ) Notice: Subject to any disclaimer, the term of this patent is extended or adjusted under 35 U.S.C. 154(b) by 824 days.

(21) Appl. No.: 12/984,752

(22) Filed: Jan. 5, 2011

(65) Prior Publication Data

US 2012/0171005 A1 Jul. 5, 2012

(51) Int. Cl.

| | |
|---|---|
| ***E02F 3/34*** | (2006.01) |
| ***E02F 9/16*** | (2006.01) |
| ***E02F 9/20*** | (2006.01) |
| ***G05G 9/047*** | (2006.01) |

(52) U.S. Cl.

CPC ..... *E02F 3/3414* (2013.01); *E02F 9/163* (2013.01); *E02F 9/2004* (2013.01); *G05G 9/047* (2013.01); *E02F 9/2012* (2013.01)

USPC ..... 414/685; 180/333; 91/525; 74/479.01

(58) Field of Classification Search

USPC ..... 137/636.2, 636.3; 172/812, 821; 414/2, 414/4, 685; 74/471 XY

See application file for complete search history.

(56) References Cited

U.S. PATENT DOCUMENTS

| | | | | |
|---|---|---|---|---|
| 3,854,380 | A * | 12/1974 | Casey | 91/521 |
| 3,991,832 | A | 11/1976 | Cooper | |
| 4,187,737 | A * | 2/1980 | Mori et al. | 74/471 XY |
| 4,844,685 | A | 7/1989 | Sagaser | |
| 4,978,273 | A * | 12/1990 | Radke et al. | 414/697 |
| 5,116,180 | A * | 5/1992 | Fung et al. | 414/5 |
| 5,174,115 | A | 12/1992 | Jacobson et al. | |
| 5,232,057 | A | 8/1993 | Renard | |
| 5,429,037 | A * | 7/1995 | Weber et al. | 91/522 |
| 5,553,992 | A | 9/1996 | Ashcroft | |
| 5,562,398 | A | 10/1996 | Knutson | |
| 5,887,669 | A | 3/1999 | Ostler et al. | |
| 5,957,213 | A | 9/1999 | Loraas et al. | |
| 6,109,363 | A | 8/2000 | High | |
| 6,213,244 | B1 * | 4/2001 | Waggoner et al. | 180/333 |
| 6,360,459 | B1 | 3/2002 | Brookhart et al. | |
| 6,425,729 | B1 * | 7/2002 | Coutant | 414/685 |
| 6,542,789 | B2 | 4/2003 | Ufheil | |
| 6,550,562 | B2 | 4/2003 | Brandt et al. | |
| 6,601,670 | B2 | 8/2003 | Kaneda et al. | |
| 6,840,334 | B2 | 1/2005 | Marquardt | |
| 6,892,481 | B2 * | 5/2005 | Yamamoto et al. | 37/348 |
| 7,017,674 | B2 | 3/2006 | Bell et al. | |
| 7,334,658 | B2 * | 2/2008 | Berg et al. | 180/333 |
| 7,401,542 | B2 * | 7/2008 | Stephens et al. | 91/525 |
| 2009/0319097 | A1 * | 12/2009 | Bandera et al. | 701/3 |

* cited by examiner

*Primary Examiner* — Gregory Adams

(74) *Attorney, Agent, or Firm* — Sue C. Watson

(57) ABSTRACT

A work vehicle includes a motor associated with selectable movement of a frame by a first operator control. The frame structurally carries a cab structure and a manipulating structure associated with an implement for performing work. The manipulating structure is selectably movable by a second operator control located in the cab structure. All control functions associated with positioning the implement with respect to three different rotational axes are manipulable using the second operator control.

15 Claims, 2 Drawing Sheets

SKID STEER LOADER BLADE CONTROL

FIELD OF THE INVENTION

The present invention relates generally to the field of work vehicles having implements for performing work. It relates more particularly to implement control of work vehicles.

BACKGROUND OF THE INVENTION

Work vehicles, such as a skid steer loader, are increasingly being used on job sites. Skid steer loaders are typically used as general utility machines, due to their versatility and ability to operate on job sites having reduced amounts of surface area.

Despite their versatility, skid steer loaders may be configured differently to control implements, such as a blade or bucket, with which to perform work. That is, the controls may be located in different positions, or perform different functions with respect to the implement, such as raising the arms or rotating the implement about a rotational axis. These differences in control locations and/or different functions result in operator confusion, further resulting in reduced productivity. Moreover, current skid steer loaders do not incorporate all control functions for positioning an implement within a single operator control, such as a hand control, which could simplify operation of the work vehicle.

Accordingly, it would be advantageous to incorporate all control functions for positioning an implement for a work vehicle in a single operator control.

SUMMARY OF THE INVENTION

The present invention further relates to a work vehicle including a motor associated with selectable movement of a frame by a first operator control. The frame structurally carries a cab structure and a manipulating structure associated with an implement for performing work. The manipulating structure is selectably movable by a second operator control located in the cab structure. All control functions associated with positioning the implement with respect to three different rotational axes are manipulable using the second operator control.

The present invention further relates to a method of operating a work vehicle, including providing a motor associated with selectable movement of a frame by a first operator control, the frame structurally carrying a cab structure and a manipulating structure associated with an implement for performing work, the manipulating structure selectably movable by a second operator control located in the cab structure. The method further includes positioning the implement with respect to three different rotational axes by manipulation of the second operator control.

The present invention yet further relates to a work vehicle including a motor associated with selectable movement of a frame by a first operator control. The frame structurally carries a cab structure and a manipulating structure associated with an implement for performing work. The manipulating structure is selectably movable by a second operator control located in the cab structure. All control functions associated with positioning the implement with respect to three different, mutually perpendicular rotational axes are manipulable using the second operator control.

An advantage of the present invention is the ability to incorporate all control functions for positioning an implement of a work vehicle within a single operator control.

Other features and advantages of the present invention will be apparent from the following more detailed description of the preferred embodiment, taken in conjunction with the accompanying drawings which illustrate, by way of example, the principles of the invention.

BRIEF DESCRIPTION OF THE DRAWINGS

Wherever possible, the same reference numbers will be used throughout the drawings to refer to the same or like parts.

DETAILED DESCRIPTION OF THE INVENTION

Figure 1:
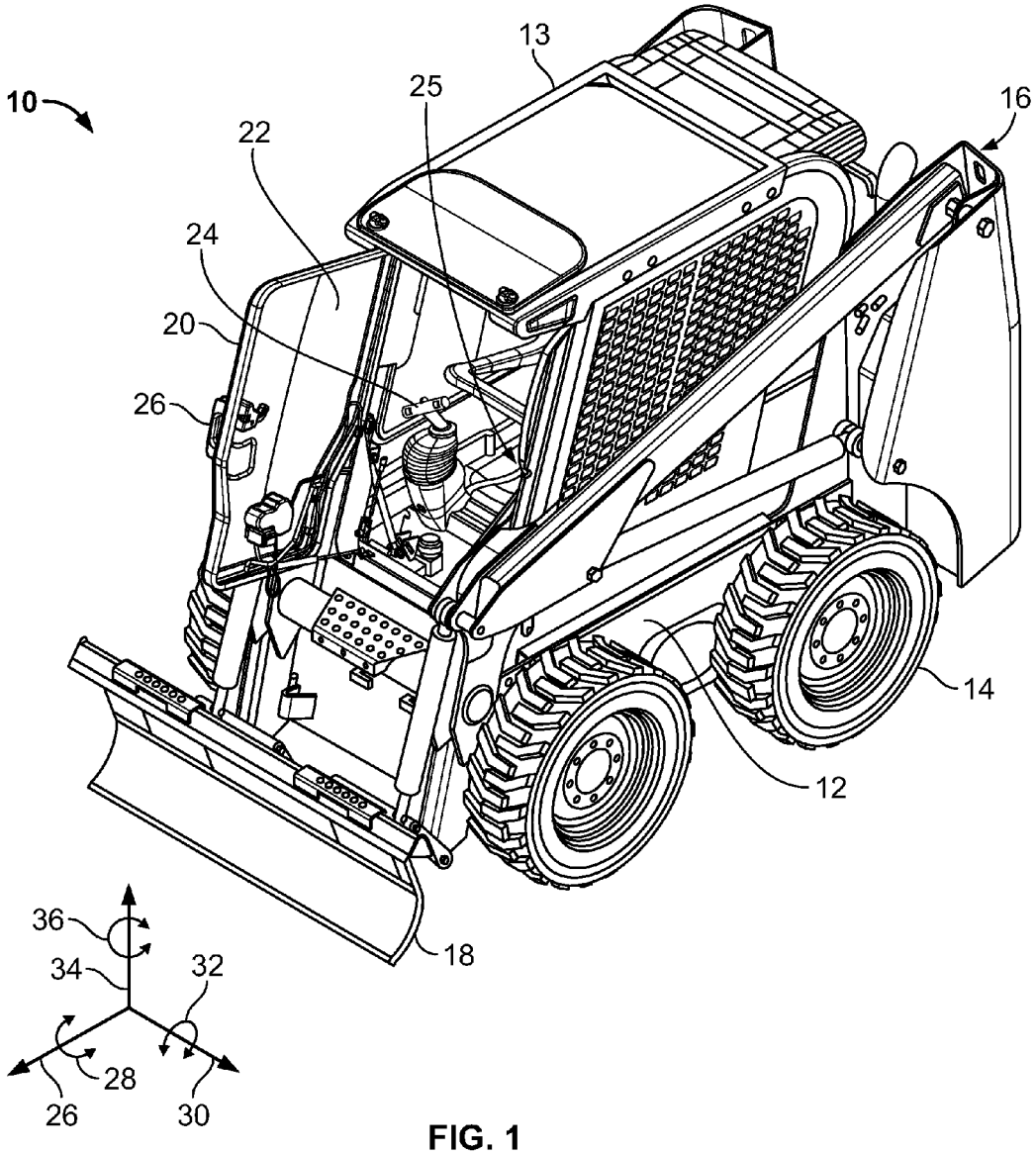
FIG. 1 is a top perspective view of an embodiment of a work vehicle of the present invention.

FIG. 1 shows a work vehicle 10 provided with a frame 12 that rotatably carries a plurality of wheels 14. Alternately, a track drive or other appropriate drive system to movably drive the frame may be used. A manipulating structure 16 includes an arrangement of structural members and actuators controllable by an operator (not shown) such as by a second operator control 24, such as a joystick or lever, to manipulate an implement 18 to perform work. As further shown in FIG. 1, second operator control 24 for controlling the work vehicle by certain movements of an operator's right hand with respect to the controls are located within a cab structure 13. Typically, a first operator control 25 associated with an operator's left hand is associated with controlling other operational aspects of the work vehicle such as speed and direction. Frame 12 structurally supports cab structure 13 to surround and protect the operator. A door 20 provides operator ingress/egress to work vehicle 10, including a transparent member 22 through which an operator may view a work environment exterior of the work vehicle. In an alternate embodiment, the work vehicle may not have a door.

It is to be understood that the term manipulating structure not only refers to the device that is to perform work, and further includes the implement, such as a bucket or blade, but also refers to structural/fluid components required to control the manipulating structures.

FIG. 1 further shows a plurality of axes and rotational movements associated with respect to those axes as pertains to work vehicle 10. These axes and rotational movements are provided to correspond to associated movements by implement 18. An axis 26 corresponds to a movement of the work vehicle in a longitudinal or "straight-ahead" direction. A rotational movement 28 of the implement about axis 26, sometimes referred to as "tilt" or roll, typically uses an auxiliary hydraulic circuit of the work vehicle (not shown). An axis 34 corresponds to a substantially vertical direction or "up" with respect to an operator seated inside the cab of the work vehicle. A rotational movement 36 of the implement about axis 34, sometimes referred to as "angle" or yaw, typically uses an auxiliary hydraulic circuit of the work vehicle. Since both rotational movement 28 ("tilt" or roll) and rotational movement 36 ("angle" or yaw) typically utilize the same auxiliary hydraulics circuit, a conventional control would typically designate a switch (not shown) to toggle between the two different rotational movements 28, 36, preventing an operator from simultaneously performing the rotational movements. That is, an operator formerly would be required to perform rotational movement 28 prior to performing rotational movement 36 (or vice versa), or switching between a series of rotational movements 28, 26, which would increase the time associated with achieving a desired position of an implement 18 requiring both rotational movements, as well as further complicating the tasks of the operator associated with control of the work vehicle.

Figure 2:
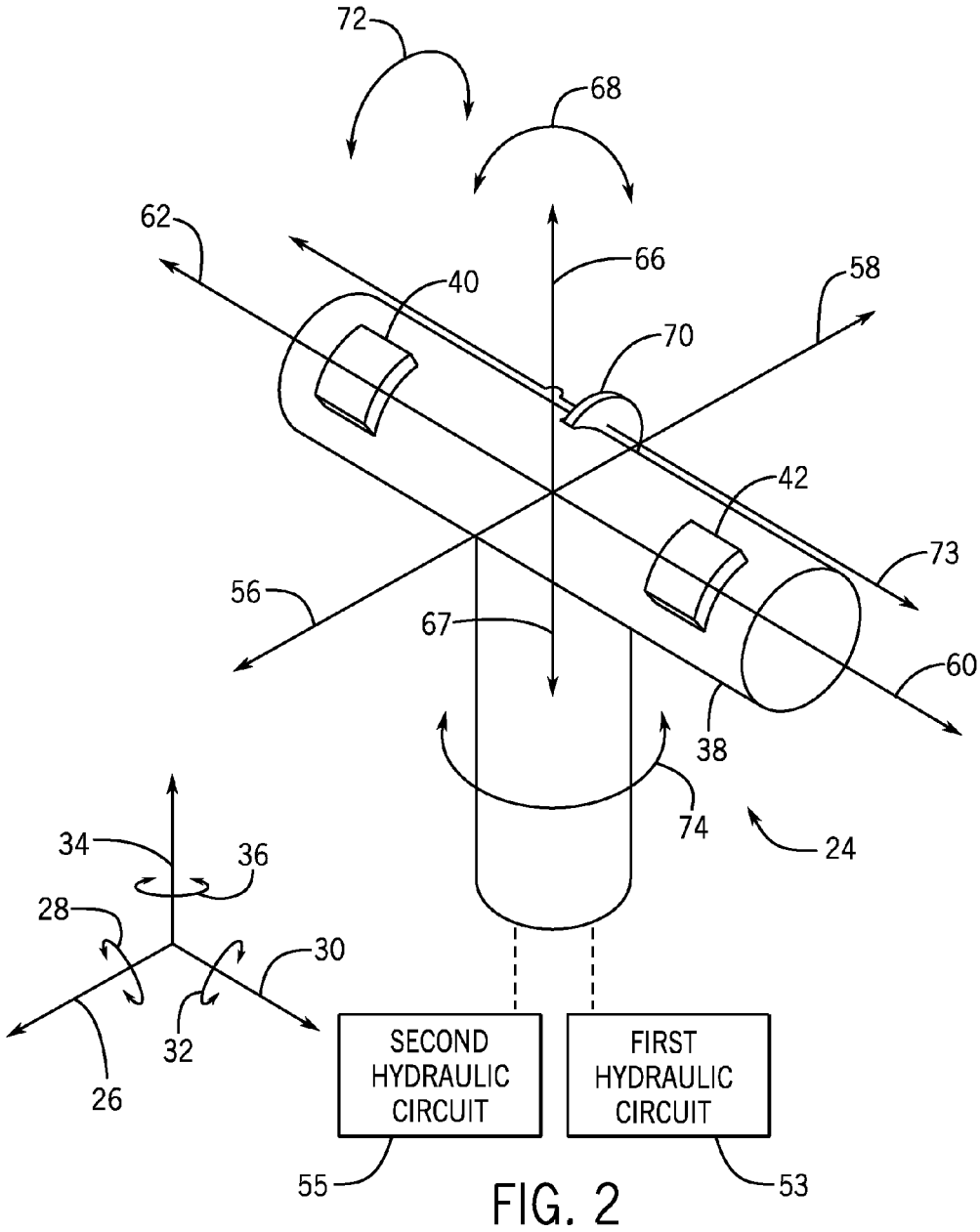
FIG. 2 is a top perspective view of a control of the present invention.

FIG. 1 also shows an axis 30 which would correspond to a lateral or side direction with respect to an operator seated inside the cab of the work vehicle. For example, axis 30 would correspond to a left hand direction that is substantially perpendicular to axis 26. A rotational movement 32 of an implement about axis 30, sometimes referred to as a "back-angle" or pitch, typically uses the lift circuit of the manipulating structure 16 of the work vehicle 10. In one embodiment, while rotational movement 32 of the manipulating structure 16 would correspond to a change in the "back-angle" or pitch of the implement 18, an operator could manipulate a switch or "thumb wheel" such as a thumb wheel 70 as shown in FIG. 2 to substantially maintain a predetermined "back-angle" or pitch of the implement. However in another embodiment, the implement 18 could automatically be maintained at a fixed orientation with respect to axis 34 in a manner similar to that disclosed in U.S. Pat. No. 4,844,685, which is hereby incorporated by reference in its entirety.

While axes 26, 30, 34 are shown mutually perpendicular to each other in FIG. 1, in other embodiments the axes may not be mutually perpendicular to each other.

As shown in FIG. 2, an exemplary embodiment effects positional control of implement 18 by virtue of manual manipulation of second operator control 24. As discussed above, a rotational movement 28 of the implement about axis 26, sometimes referred to as "tilt" or roll, uses an auxiliary hydraulic circuit 53 (e.g., a first hydraulic circuit) of the work vehicle. A rotational movement 36 of the implement about axis 34, sometimes referred to as "angle" or yaw, uses the auxiliary hydraulic circuit 53 of the work vehicle. Thus, both rotational movement 28 ("tilt" or roll) and rotational movement 36 ("angle" or yaw) utilize the same auxiliary hydraulic circuit 53. A rotational movement 32 of an implement about axis 30, sometimes referred to as a "back-angle" or pitch, uses a lift circuit 55 (e.g., a second hydraulic circuit) of the manipulating structure 16 of the work vehicle 10. For example, counterclockwise rotational movement 68 of the second operator control about an axis 56, which is substantially parallel to axis 26, would result in rotational movement 32 of manipulating structure 16 about axis 30, lowering an end of manipulating structure 16, thereby similarly lowering implement 18. As earlier discussed, the operator may be required to modify the "back angle" of the implement in response to rotational movement 32, such as by rotating wheel 70 associated with second operator control 24, or incorporating an automatic system for maintaining a constant "back angle" during such rotational movement. As illustrated, the rotating wheel 70 may rotate about a secondary rotational axis 73, wherein the secondary rotational axis 73 is substantially parallel to one of the three different rotational axes, such as axis 30. Conversely, counterclockwise rotational movement 68 of the second operator control about axis 58, which extends in a direction opposite of axis 56, would result in rotational movement 32 of manipulating structure 16 about axis 30, raising an end of manipulating structure, thereby similarly raising implement 18.

As further shown in FIG. 2, clockwise rotational movement 74 of second operator control 24 about an axis 66, which is substantially parallel to axis 34, would result in rotational movement 36 of implement 18 about axis 34 in a counterclockwise direction. Conversely, clockwise rotational movement 74 of second operator control 24 about the axis 67, which extends in a direction opposite of axis 66, would result in rotational movement 36 of implement 18 about axis 34 in a clockwise direction.

As further shown in FIG. 2, counterclockwise rotational movement 68 of second operator control 24 about axis 56 would result in counterclockwise rotational movement 28, sometimes referred to as "tilt" or roll of implement 18 about axis 26. To ease the ability of the operator to sufficiently grasp the second operator control in order to achieve rotational movement 68, extensions 38 are provided that extend along respective axes 60, 62. Conversely, clockwise rotational movement 68 of second operator control 24 about axis 56 would result in clockwise rotational movement 28 about axis 26.

It is to be understood that simultaneous movements, rotational and/or axial, of the second operator control may be performed to likewise simultaneously move the implement in two or more rotational/axial directions. For example, movement of the second operator control in a direction that is between axis 36 and axis 60 may result in a simultaneous combination of rotational movement 32 and rotational movement 36. Other combinations may be used. In other embodiments, one or more axial movements of second operator control 24 such as along axes 56, 58, axes 60, 62 or axes 66, 67 may be utilized in place of, or in combination with, rotational movements, such as previously discussed to affect positioning of the work vehicle implement.

The manipulations of second operator control 24 as described above represent an exemplary embodiment; other manipulations to achieve positional control of the implement using the second operator control may be utilized/customized. That is, second operator control 24 is reconfigurable. For example, switch 40 may reverse the previously described functionalities of the second operator control such that rotational movement 74 of the second operator control about axes 60, 62 (formerly resulting in rotational movement 36) and rotational movement 72 of the second operator control about axes 56, 58 (formerly resulting in rotational movement 32) would be reversed. Similarly, switch 42 could reverse a combination of other previously described functionalities of the second operator control, such as reversing the controlled movements of implement 18 between rotational movement 74 about axes 60, 62 (formerly resulting in rotational movement 36) and rotational movement 68 (formerly resulting in rotational movement 28). Alternately, a switch could add an additional rotational movement functionality to the second operator control, such as associating an axial movement along axes 60, 62 to correspond to a rotational movement of the implement. In yet a further embodiment, associating an axial movement along axes 66, 67 could similarly correspond to a rotational movement of the implement. That is, such combinations of axial movement and/or rotational movement of the second operator control could be customized to correspond to an operator's preference.

In other words, second operator control 24 may be configured such that all control functions associated with positioning the implement with respect to three different rotational axes are manipulable using a second operator control.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A work vehicle comprising:

a motor associated with selectable movement of a frame by a first operator control;

the frame structurally carrying a cab structure and a manipulating structure associated with an implement for performing work, wherein the manipulating structure is selectably movable by a second operator control located in the cab structure, the manipulating structure is configured to position the implement with respect to three different rotational axes via a first hydraulic circuit and a second hydraulic circuit, the first hydraulic circuit is configured to position the implement with respect to one rotational axis, the second hydraulic circuit is configured to position the implement with respect to two remaining rotational axes, the three rotational axes comprise a first axis, a second axis, and a third axis, the first hydraulic circuit controls pitching movement of the implement about the first axis and the second hydraulic circuit respectively controls tilting and yawing movement of the implement about the second and third axes; and a third operator control coupled to the second operator control and configured to move in a direction that corresponds to a secondary rotational axis, wherein the secondary rotational axis is parallel to the first, second, or third rotational axis, and wherein the third operator control is a thumbwheel;

wherein rotation of the second operator control about each of three control axes is configured to cause corresponding rotation of the implement about a respective one of the three different rotational axes, and the second operator control is configured to manipulate all control functions associated with positioning the implement with respect to the three different rotational axes by controlling the first and second hydraulic circuits.

2. The work vehicle of claim 1, wherein the second operator control is a hand control.

3. The work vehicle of claim 1, wherein the three rotational axes are mutually perpendicular to each other.

4. The work vehicle of claim 1, wherein the implement is maintainable at a fixed angular orientation with one axis of the three rotational axes while the implement is rotated about at least one of the remaining two axes.

5. The work vehicle of claim 1, wherein the implement is a blade or a bucket.

6. The work vehicle of claim 1, wherein at least one of the control functions of the second operator control is reconfigurable.

7. A method of operating a work vehicle comprising:

providing a motor associated with selectable movement of a frame by a first operator control;

providing the frame structurally carrying a cab structure and a manipulating structure associated with an implement for performing work, wherein the manipulating structure is selectably movable by a second operator control located in the cab structure, the manipulating structure is configured to position the implement with respect to three different rotational axes via a first hydraulic circuit and a second hydraulic circuit, the first hydraulic circuit is configured to position the implement with respect to one rotational axis, the second hydraulic circuit is configured to position the implement with respect to two remaining rotational axes, the three rotational axes comprise a first axis, a second axis, and a third axis, the first hydraulic circuit controls pitching movement of the implement about the first axis, and the second hydraulic circuit respectively controls tilting and yawing movement of the implement about the second and third axes, wherein a third operator control is coupled to the second operator control and configured to move in a direction that corresponds to a secondary rotational axis, wherein the secondary rotational axis is parallel to the first, second, or third rotational axis, and wherein the third operator control is a thumbwheel; and positioning the implement with respect to the three different rotational axes by controlling the first and second hydraulic circuits via manipulation of the second operator control, wherein rotation of the second operator control about each of three control axes causes corresponding rotation of the implement about a respective one of the three different rotational axes.

8. The method of claim 7, wherein positioning the implement includes maintaining the implement at a fixed angular orientation with one axis of the three rotational axes while the implement is rotated about at least one of the remaining two axes.

9. The method of claim 7, wherein the second operator control is a hand control.

10. The method of claim 7, wherein at least one of the control functions of the second operator control is reconfigurable.

11. A work vehicle comprising:

a motor associated with selectable movement of a frame by a first operator control;

the frame structurally carrying a cab structure and a manipulating structure associated with an implement for performing work;

a second operator control located in the cab structure, wherein the second operator control is configured to manipulate all control functions associated with positioning the implement with respect to three different rotational axes by selectively moving the manipulating structure, the second operator control is a hand control configured to move in three different directions, movement of the hand control in each of the three directions causes corresponding movement of the implement with respect to a respective one of the three different rotational axes via only two hydraulic circuits, the three different rotational axes comprise a first axis, a second axis, and a third axis, a first hydraulic circuit controls pitching movement of the implement about the first axis, and a second hydraulic circuit respectively controls tilting and yawing movement of the implement about the second and third axes; and a third operator control coupled to the hand control and configured to move in a fourth direction that corresponds to a secondary rotational axis, wherein the secondary rotational axis is parallel to one of the three different rotational axes.

12. The work vehicle of claim 11, wherein the implement is maintainable at a fixed angular orientation with one axis of the three rotational axes while the implement is rotated about at least one of the remaining two axes.

13. The work vehicle of claim 11, wherein the implement is a blade or a bucket.

14. The work vehicle of claim 11, wherein at least one of the control functions of the second operator control is reconfigurable.

15. The work vehicle of claim 11, wherein the third operator control is a thumb wheel configured to rotate in the fourth direction.

* * * * *